US006042017A

United States Patent [19]

Ban et al.

[11] Patent Number: 6,042,017

[45] Date of Patent: Mar. 28, 2000

[54] HEAT GENERATOR FOR VEHICLES AND ITS OPERATING METHOD

[75] Inventors: Takashi Ban; Tatsuyuki Hoshino; Takanori Okabe; Takahisa Ban, all of Kariya, Japan

[73] Assignee: Kabushiki Kaisha Toyoda Jidoshokki Seisakusho, Kariya, Japan

[21] Appl. No.: 09/199,741

[22] Filed: Nov. 25, 1998

[30] Foreign Application Priority Data

Nov. 27, 1997 [JP] Japan ..... 9-326429

[51] Int. Cl.[7] ..... B60H 1/02

[52] U.S. Cl. ..... 237/12.3 R; 237/12.3 B; 122/26; 126/247

[58] Field of Search ..... 237/12.3 B, 12.3 R; 122/26; 126/247; 123/142.5

[56] References Cited

U.S. PATENT DOCUMENTS 4,974,778 12/1990 Bertling .

5,819,724 10/1998 Hybertson ..... 126/247

FOREIGN PATENT DOCUMENTS 3-98107 10/1991 Japan .

*Primary Examiner*—Henry A. Bennett
*Assistant Examiner*—Derek S. Boles
*Attorney, Agent, or Firm*—Morgan & Finnegan, L.L.P.

[57] ABSTRACT

A vehicle heater for generating heat for heating a vehicle compartment. The heater includes a rotor rotated by a vehicle engine. The rotor has a predetermined thickness and a peripheral edge. The heater further includes a heating chamber for accommodating the rotor and a fluid. The fluid is heated in the heating chamber when the rotor rotates. The heater further includes a reservoir. The fluid from the heating chamber is stored in the reservoir. The heater further includes a return passage connecting the reservoir and the heating chamber. The fluid returns from the heating chamber to the reservoir through the return passage. The return passage has an entrance opening in an inner wall of the heating chamber. The entrance opening faces the peripheral edge of the rotor, and the maximum width of the entrance opening is greater than the thickness of the rotor.

20 Claims, 7 Drawing Sheets

HEAT GENERATOR FOR VEHICLES AND ITS OPERATING METHOD

BACKGROUND OF THE INVENTION

The present invention relates to a heater for vehicles. More specifically, the present invention pertains to a heater that has a rotor and viscous fluid in its housing and generates heat by the rotor rotation shearing the viscous fluid.

A heater using the drive force of a vehicle engine is described, for example, in a U.S. Pat. No. 4,974,778. The heater will now be described with reference to FIG. 7.

A conventional heater 70 has a housing including a heating chamber 72 and a ring-shaped space 73. The ring-shaped space 73 is formed adjacent to the outer side of the heating chamber 72. Further, a reservoir 74 is partitioned parallel to the heating chamber 72. A middle wall 75 separates the heating chamber 72 and the reservoir 74. A drive shaft 76 is supported to rotate in the housing. A rotor 77, which rotates integrally with the drive shaft 76 in the heating chamber, is rigidly attached to one end of the drive shaft 76, and a pulley 78 is fixed to the other end of the drive shaft 76. The pulley 78 is rotated by the engine drive force by way of a belt.

A certain amount of viscous fluid 79 is put in the heating chamber 72 and the reservoir 74, occupying a clearance 82 between the peripheral surface 80 of the rotor 77 and an inner wall 81 of the heating chamber 72. A supply passage 83 and a return passage 84 are formed in the middle wall 75. The supply passage 83 supplies the fluid from the reservoir 74 to the heating chamber 72, and the return passage 84 returns the fluid back to the reservoir 74. The opening degree of the supply passage 83 is adjusted by a lever 86, which is controlled by a bimetallic plate spring 85. This adjusts the heat generation capacity of the heater 70. When the temperature of a coolant 88 has not reached a required level for heating, the bimetallic plate spring 85 maintains the supply passage 83 open. This permits the supply of viscous fluid 79 from the reservoir 74 to the heating chamber 72.

When the drive force of the engine is transmitted to the pulley 78, the rotor 77 rotates with the drive shaft 76 in the heating chamber 72. This shears the viscous fluid 79 between the rotor periphery 80 and the inner wall 81 and generates heat. The heat is transferred to the coolant 88 flowing in the ring-shaped space 73, through partitions 87 and supplied to a heat exchanger of a heating apparatus for vehicles. The fluid is returned to the reservoir by centrifugal force via the return passage 84.

The return of the viscous fluid from the heating chamber to the reservoir is stopped when the rotor stops with the engine. This leaves a substantial amount of viscous fluid adhering to the rotor in the heating chamber. When the rotor is restarted in this state, a load resulting from the adhered fluid is applied to the engine through the rotor and the belt. This may cause the drive belt to slip. As a result, ride comfort is deteriorated, and noise and wear of the heater parts are more likely to occur. Accordingly, one technical challenge has been to lower the load when starting the rotation of the rotor.

SUMMARY OF THE INVENTION

The objective of the present invention is to provide a heater capable of lowering the load when the rotor starts to rotate.

To achieve the above objective, the present invention provides a vehicle heater for generating heat for heating a vehicle compartment. The heater includes a rotor rotated by a vehicle engine. The rotor has a predetermined thickness and a peripheral edge. The heater further includes a heating chamber for accommodating the rotor and a fluid. The fluid is heated in the heating chamber when the rotor rotates. The heater further includes a reservoir. The fluid from the heating chamber is stored in the reservoir. The heater further includes a return passage connecting the reservoir and the heating chamber. The fluid returns from the heating chamber to the reservoir through the return passage. The return passage has an entrance opening in an inner wall of the heating chamber. The entrance opening faces the peripheral edge of the rotor, and the maximum width of the entrance opening is greater than the thickness of the rotor.

The present invention further provides a method of operating a viscous fluid heater in a vehicle. The vehicle has an engine that rotates a rotor of the heater. The heater has a heating chamber and a reservoir. The heating chamber houses the rotor and contains viscous fluid. The reservoir stores viscous fluid. The method includes a step of starting the engine in the vehicle, and at approximately the same time that the engine is started, a step of opening a valve in a return passage of the viscous heater. In this way, viscous fluid is forced from the heating chamber to the reservoir to remove viscous fluid from the heating chamber and thus reduce the torque load produced by the viscous heater on the engine. The viscous fluid is forced from the heating chamber by movement of the rotor.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

An embodiment of the present invention will now be described in reference to FIGS. 1–6.

Figure 1:
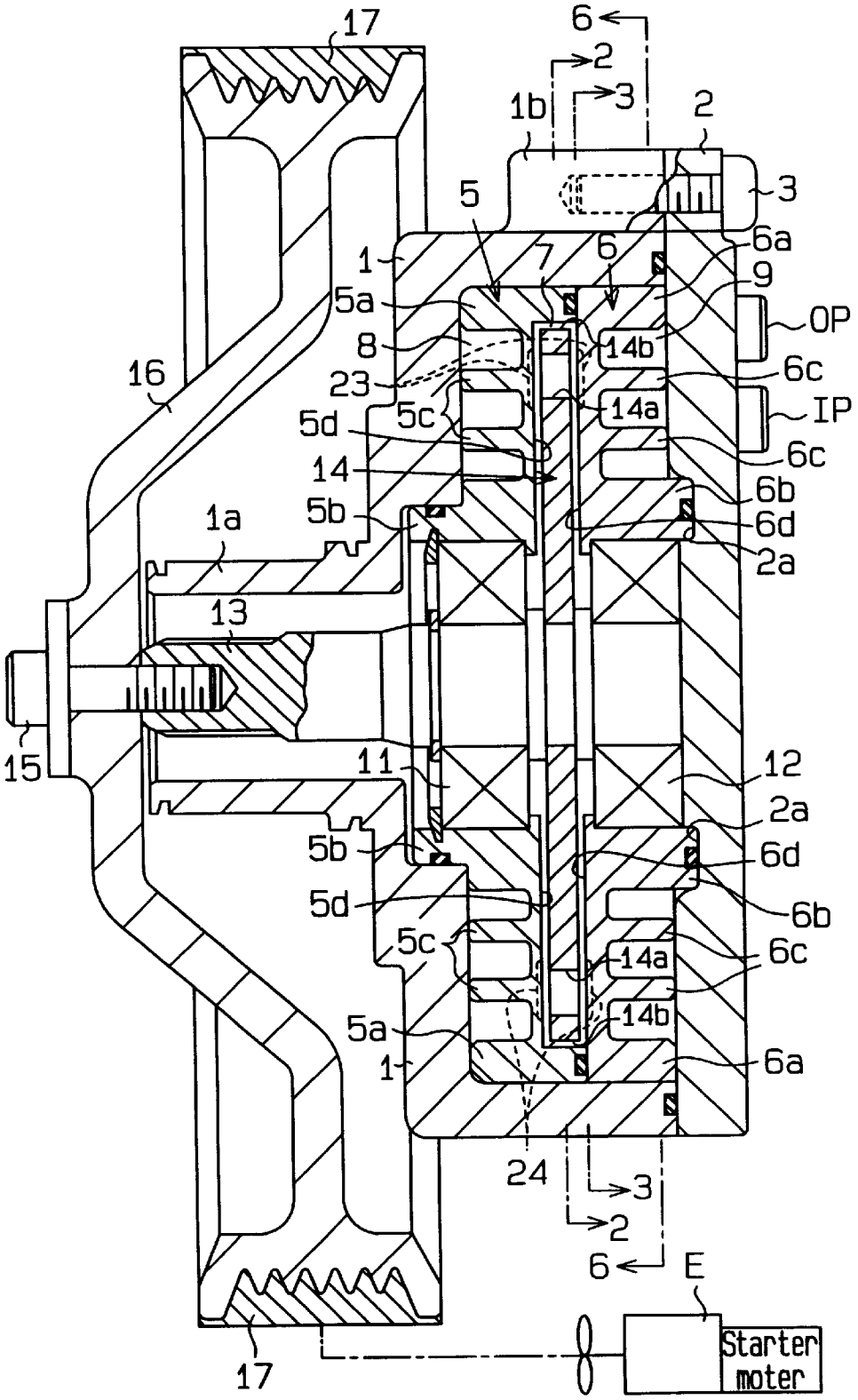
FIG. 1 is a cross-sectional view of a vehicle heater of an embodiment according to the present invention.

As shown in FIG. 1, a vehicle heater includes a first housing part 1 and a second housing part 2. The first housing part 1 includes a boss la and a cylindrical portion 1*b*, which supports the proximal end of the boss 1*a*. The boss 1*a*, which is cylindrical, extends forward (leftward in FIG. 1). The cylindrical portion 1*b* has a large opening on the side opposite to the boss 1*a*. The second housing part 2 covers the large opening. The housing parts 1 and 2 are fastened by six bolts 3 (See FIG. 2).

The housing parts 1, 2 house first and second partition plates 5 and 6. Each plate 5, 6 has a corresponding annular rim 5*a* or 6*a*. When the housing parts are fastened together, the plates 5, 6 are secured and the rims 5*a*, 6*a* are in tight contact with the inner walls of the housing parts 1, 2, making the plates 5, 6 immovable. The rim 5*a* forms a recess 5*d* on the back end surface of the partition plate 5. The recess 5*d* and a front end surface 6*d* of the partition plate 6 form a heating chamber 7.

The first housing part 1, the second housing part 2, the first and second partition plate 5 and 6 are made of a metal, such as aluminum or an aluminum alloy.

The first partition plate 5 includes a boss 5*b* and guide fins 5*c*. The boss 5*b* conforms to the inner shape of the middle section of the first housing part 1. A seal such as an O-ring is provided on the periphery of the boss 5*b*. The guide fins 5*c* are located outward of and concentric with the boss 5*b* (See FIG. 6). The first partition plate 5 is fitted in the first housing part 1 so that the periphery of the boss 5*b* tightly contacts the inner surface of the housing part 1. Further, the guide fins 5*c* have the same length in the axial direction as the rim 5*a*. In this way, the inner surface of the first housing part 1 and the guide fins 5*c* form a first annular water jacket 8. In the water jacket 8, the rim 5*a*, the boss 5*b*, and the guide fins 5*c* guide the flow of coolant. The water jacket 8 is adjacent to the heating chamber 7 and functions as a heat transfer chamber.

Figure 6:
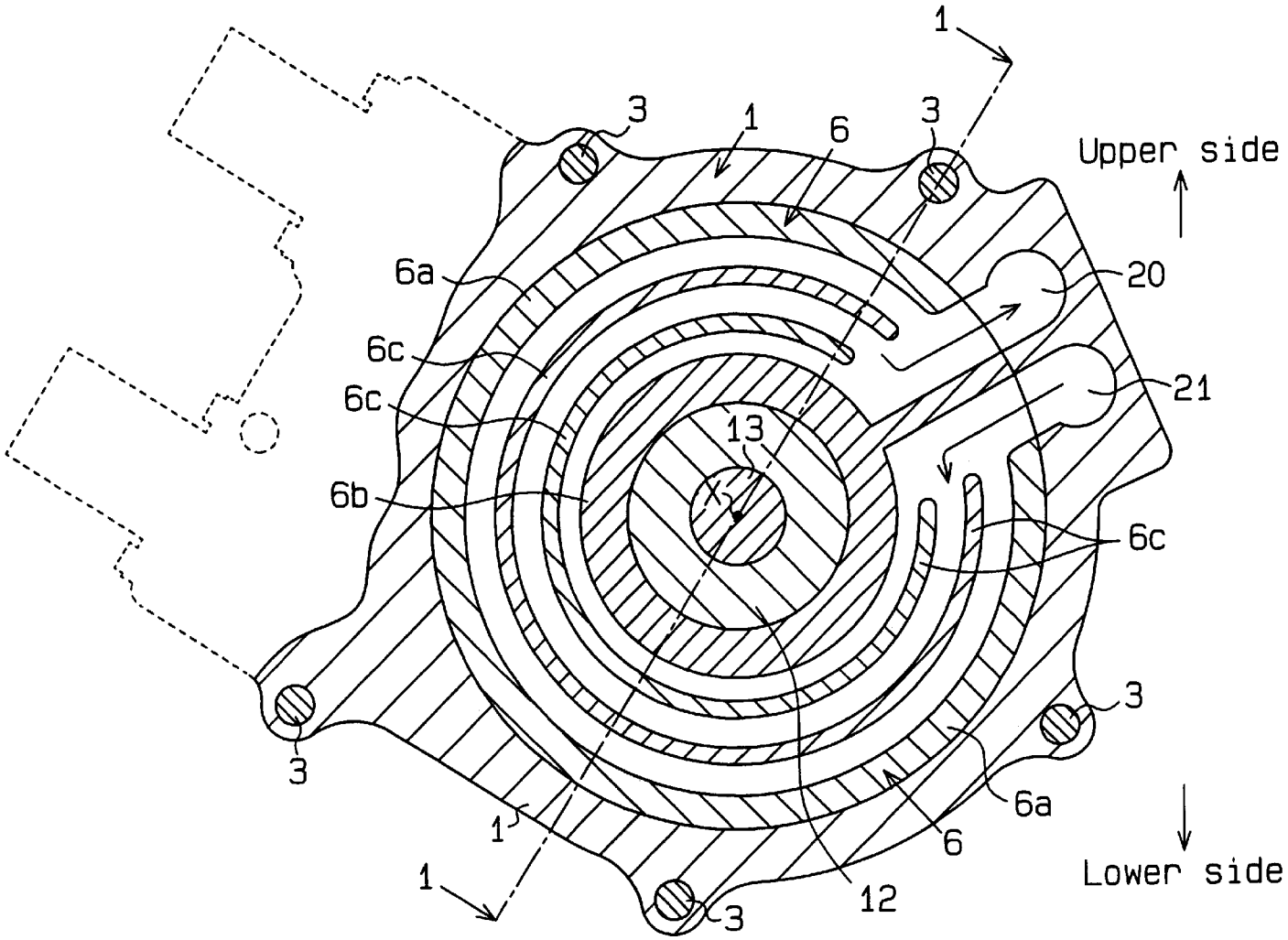
FIG. 6 is a partial sectional view taken on line 6—6 of FIG. 1.
Figure 7:
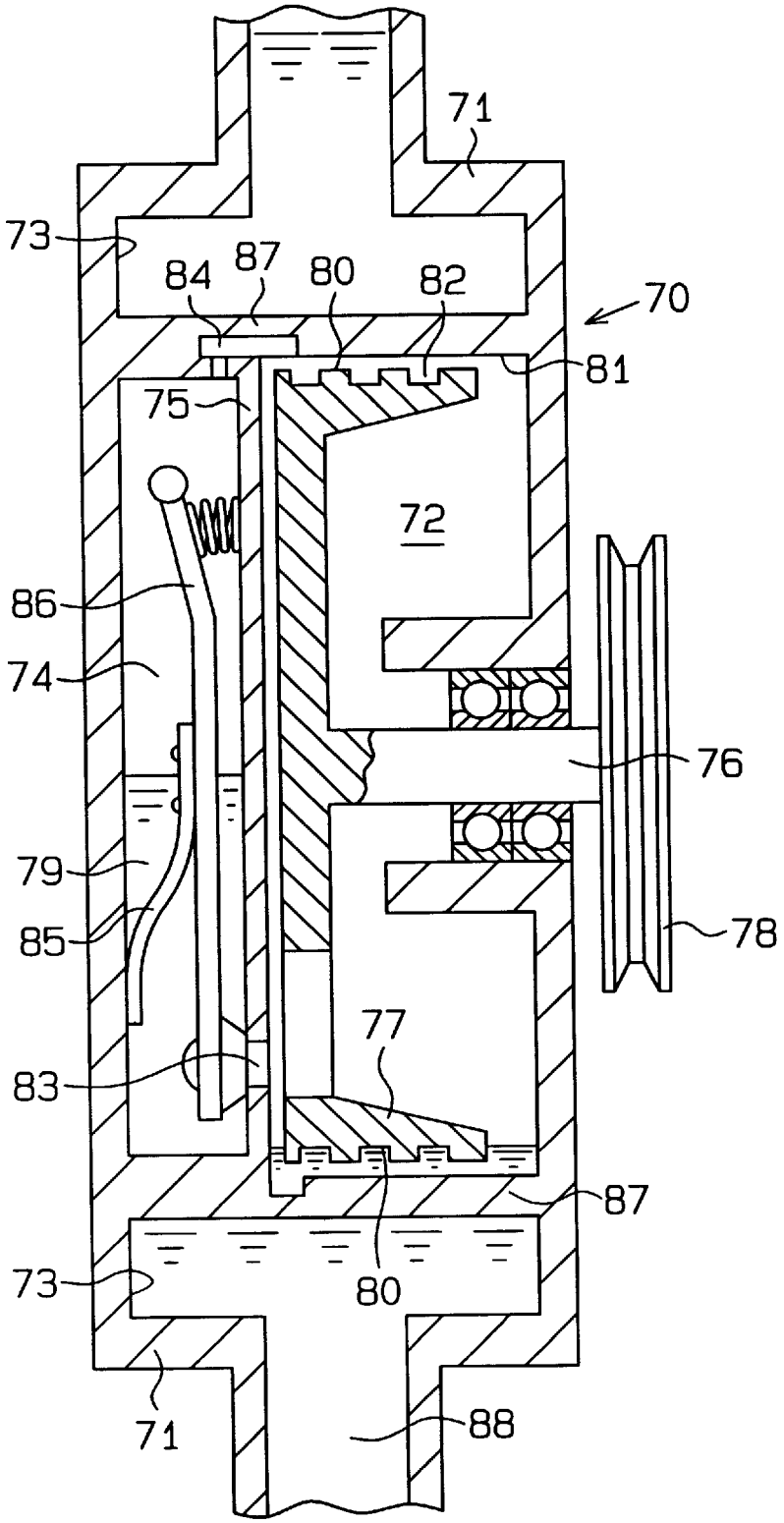
Fig.7 (Prior Art)
FIG. 7 is a cross-sectional view of a vehicle heater of an embodiment according to the prior art.

As shown in FIGS. 1 and 6, a second partition plate 6 also has a boss 6*b* and guide fins 6*c*. The boss 6*b* is formed in the middle portion of the second plate 6. The guide fins 6*c* are concentric with and are located outward from the boss 6*b*. When the second partition plate 6 is fitted in the first housing part 1, the boss 6*b* tightly contacts an annular recess 2*a* of the second housing part 2. Further, the guide fins 6*c* have the same height as the rim 6*a*. The inner surface of the second housing part 2 and the guide fins form a second annular water jacket 9. In the second water jacket 9, the rim 6*a* and the guide fins guide the flow of coolant. The second water jacket 9 is also adjacent to the heating chamber 7 and functions as a heat transfer chamber.

As shown in FIG. 1, the second housing part 2 includes an inlet port IP and an outlet port OP. The coolant from a heating circuit (not shown) is introduced to the first and second water jackets 8, 9 through the inlet port IP. Then, the coolant in the water jackets 8, 9 returns to the heating circuit through the outlet port OP (See also FIG. 6).

As shown in FIG. 1, a drive shaft 13 is rotatably supported by the first housing part 1 and the first and second plates 5, 6 through bearings 11, 12. The bearing 11 is located between the inner surface of the boss 5*b* and the periphery of the drive shaft 13 and forms a seal. The bearing 12 is located between the inner surface of the boss 6*b* and the periphery of the drive shaft and also forms a seal.

Figure 2:
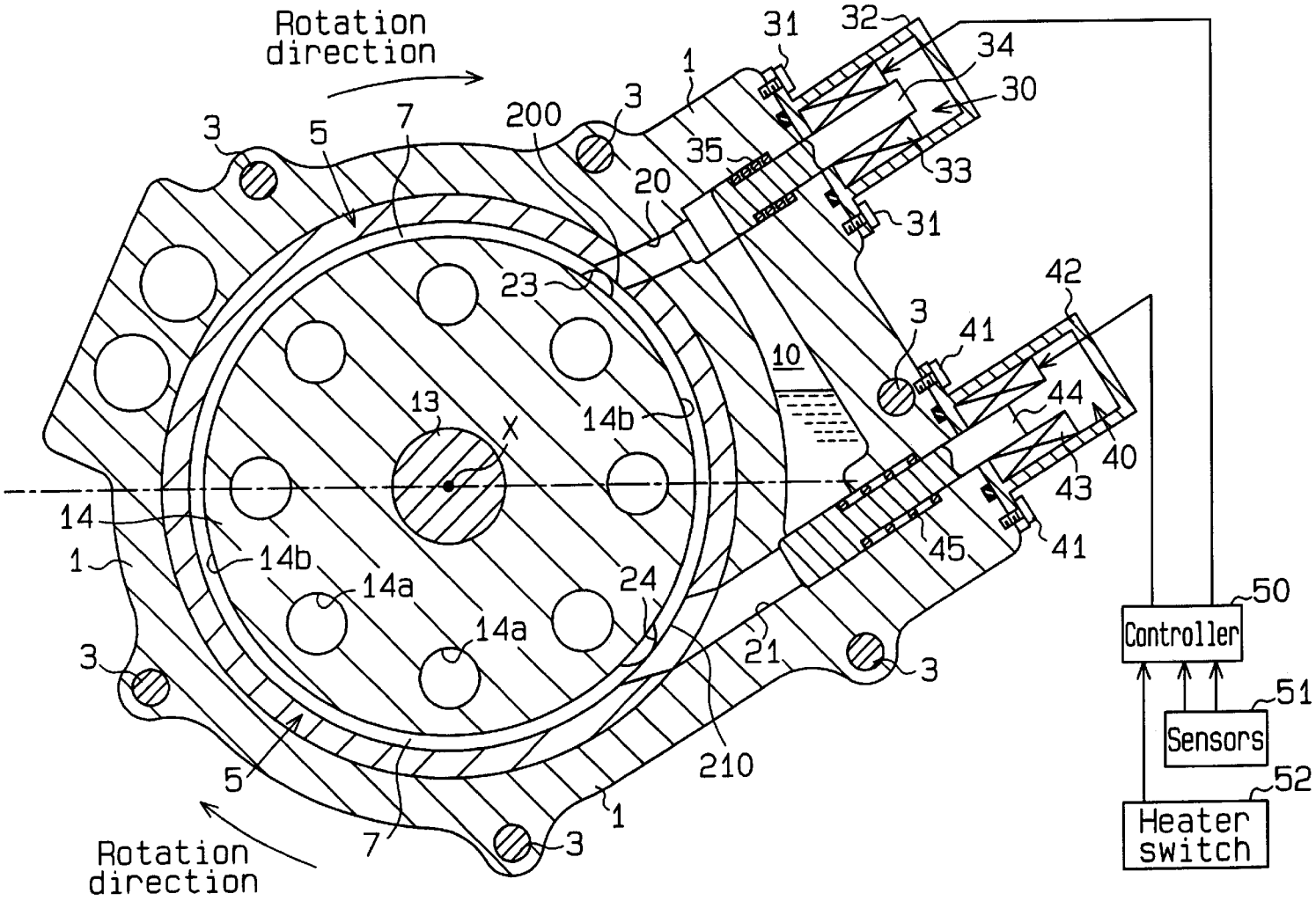
FIG. 2 is a cross-sectional view taken on line 2—2 of FIG. 1.
Figure 4:
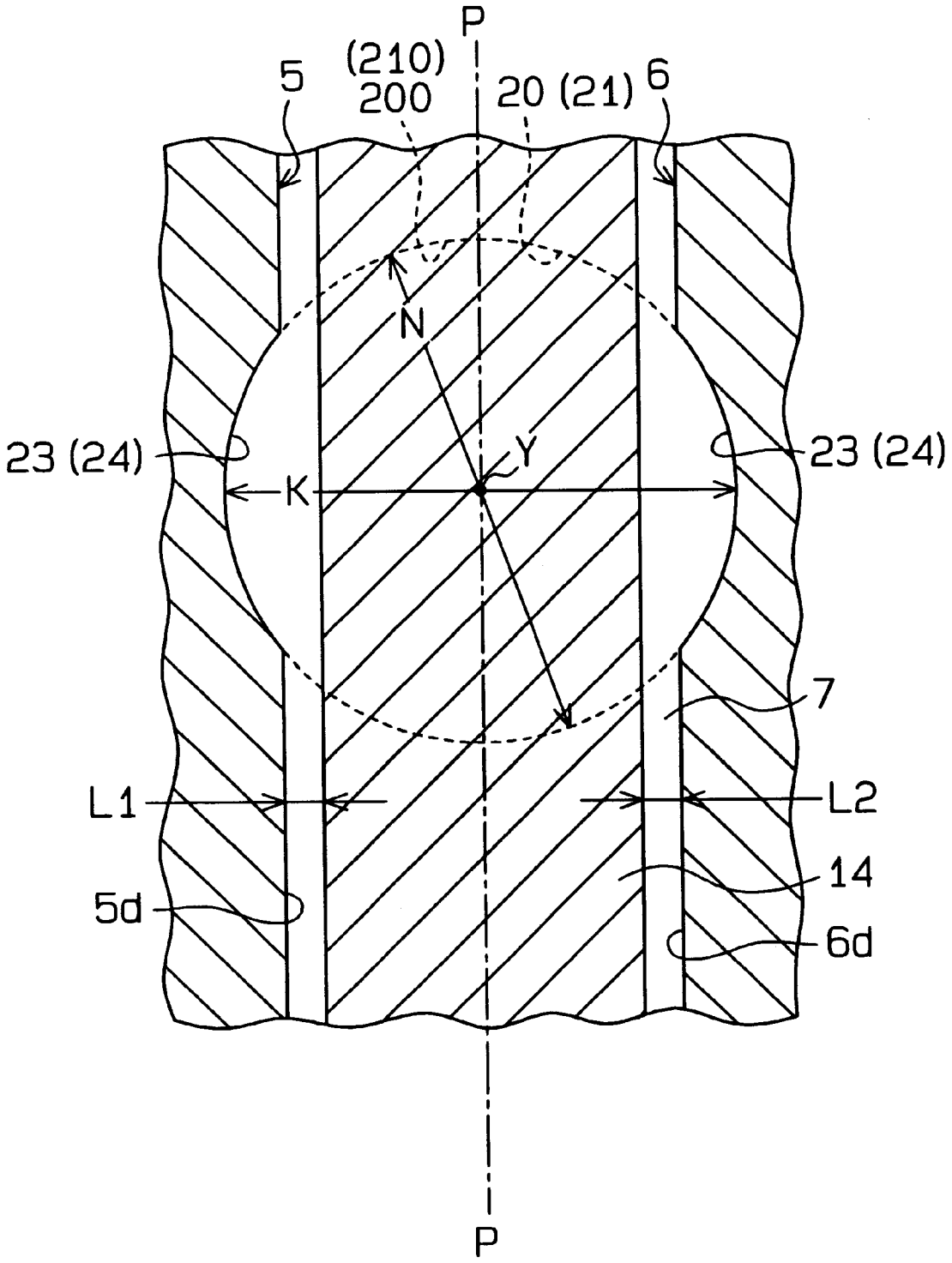
FIG. 4 is a partial sectional view taken on line 4—4 of FIG. 3.

As shown in FIGS. 1 and 2, a disk-shaped rotor 14 is fixed to the drive shaft 13 and accommodated in the heating chamber 7. Clearance exists between the rotor 14 and the inner walls of the heating chamber 7. The clearance is approximately in the range of 10 to 1000 ($\mu$m) . As shown in FIG. 4, the width of the clearance L1 between a flat part of the wall of the recess 5*d* and the rotor 14 is the same as the width of the clearance L2 between a flat part of the second plate 6 and the rotor 14 (L1=L2). A plurality of through holes 14*a* are formed near the periphery of the rotor 14. The holes 14*a* are arranged at an equal distance from the axis of the drive shaft 13 and equally spaced apart from each other.

A pulley 16 is fixed to the front end of the drive shaft 13 by a bolt 15. The pulley 16 is connected to an engine E, which serves as a drive source, through a V belt 17. The engine E includes a starter motor.

As shown in FIG. 2, a reservoir 10 is provided in the first housing part 1, outside the heating chamber 7. The reservoir 10 is formed by covering a recess of the first housing part with the second housing part 2. The reservoir 10 accommodates viscous fluid. In the present invention, silicone oil is used as a viscous fluid. When the heater is installed in a vehicle as shown in FIG. 2, the majority of the reservoir 10 is located above the axis of the drive shaft 13, so that the level of silicone oil in the reservoir 10 is much higher than that of the heating chamber 7.

Figure 3:
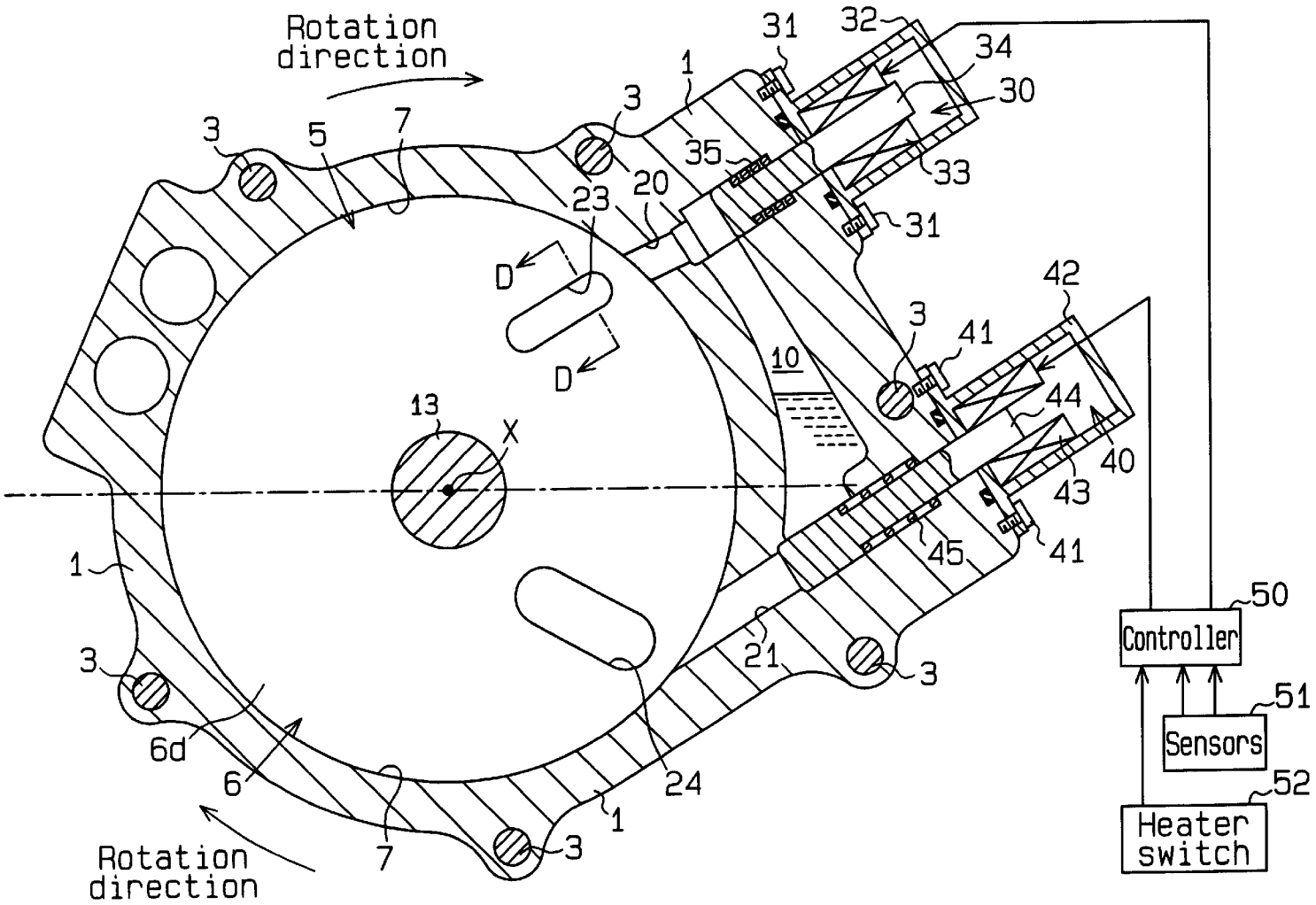
FIG. 3 is a cross-sectional view taken on line 3—3 of FIG. 1 showing the state of a heater when the rotor starts to rotate.

As shown in FIGS. 2 and 3, a return passage 20 for returning the fluid to the reservoir 10 and a supply passage 21 for supplying the fluid to the heating chamber 7 are formed in the first housing part 1 and the partition plates 5, 6. The return passage 20 and the supply passage 21 connect the heating chamber 7 and the reservoir 10.

As shown in FIG. 4, the axis of the return passage 20 is located in an imaginary plane P that bisects the rotor 14. The diameter of the entrance opening 200 of the return passage 20 is greater than the thickness of the rotor 14. The entrance opening 200 thus extends, by equal amounts, on each side of the rotor 14.

Likewise, the axis of the supply passage 21 is located in the imaginary plane P. Accordingly, an exit opening 210 of the supply passage in the heating chamber 7 extends, by equal amounts, on each side of the rotor 14. The entrance opening of the supply passage 21 in the reservoir 10 is located above the exit opening 210 of the supply passage 21, as shown in FIG. 3.

As shown in FIG. 3, a discharge groove 23 and an intake groove 24 are formed on a front surface 6*d* of the second plate 6. As shown in FIG. 4, the discharge groove 23 lies on a circular curve, the center of which is the axis of the return passage 20. The radius of the circular curve is the same as that of the return passage 20. Since one end of the discharge groove 23 is positioned near the opening 200, silicone oil flows with little resistance to the return passage 20 along the groove 23, as a result of the rotation of the rotor 14. Accordingly, the discharge groove 23 promotes the flow of the fluid from the heating chamber 7 to the reservoir 10.

The intake groove 24 extends substantially in the radial direction. One end of the groove 24 is positioned near the exit opening 210 of the supply passage 21. Accordingly, the oil from the reservoir 10 flows through the supply passage 21 and then is led to the middle area of the heating chamber 7 along the intake groove 24. That is, the intake groove 24 promotes the movement of the silicone oil in the heating chamber 7.

As shown in FIG. 4, another discharge groove 23 and another intake groove 24 are formed on the recess 5*b* of the first plate 5. The discharge groove 23 of the second plate 6 and the discharge groove 23 of the first plate 5 face each other. Similarly, the intake groove 24 of the second plate 6 and the intake groove 24 of the first plate 5 face each other.

As shown in FIG. 4, the surfaces of the discharge grooves 23 and intake grooves 24 are axially aligned and have the same radius as the openings 200, 210. Accordingly, the maximum distance K between the discharge grooves 23 is equal to the inner diameter of the entrance opening 200. The maximum distance K between the intake grooves 24 is equal to the inner diameter of the exit opening 210.

The heating chamber 7 and the reservoir 10, which are connected by the return passage 20 and the supply passage 21, form a sealed space. A predetermined amount of silicone oil occupies the sealed space. Silicone oil has viscoelasticity. The quantity of silicone oil used at a normal temperature is 50 to 80 percent of the volume of the sealed space. The return passage 20 is located above the oil level in the reservoir 10, and the supply passage 21 is located below the oil level.

Figure 5:
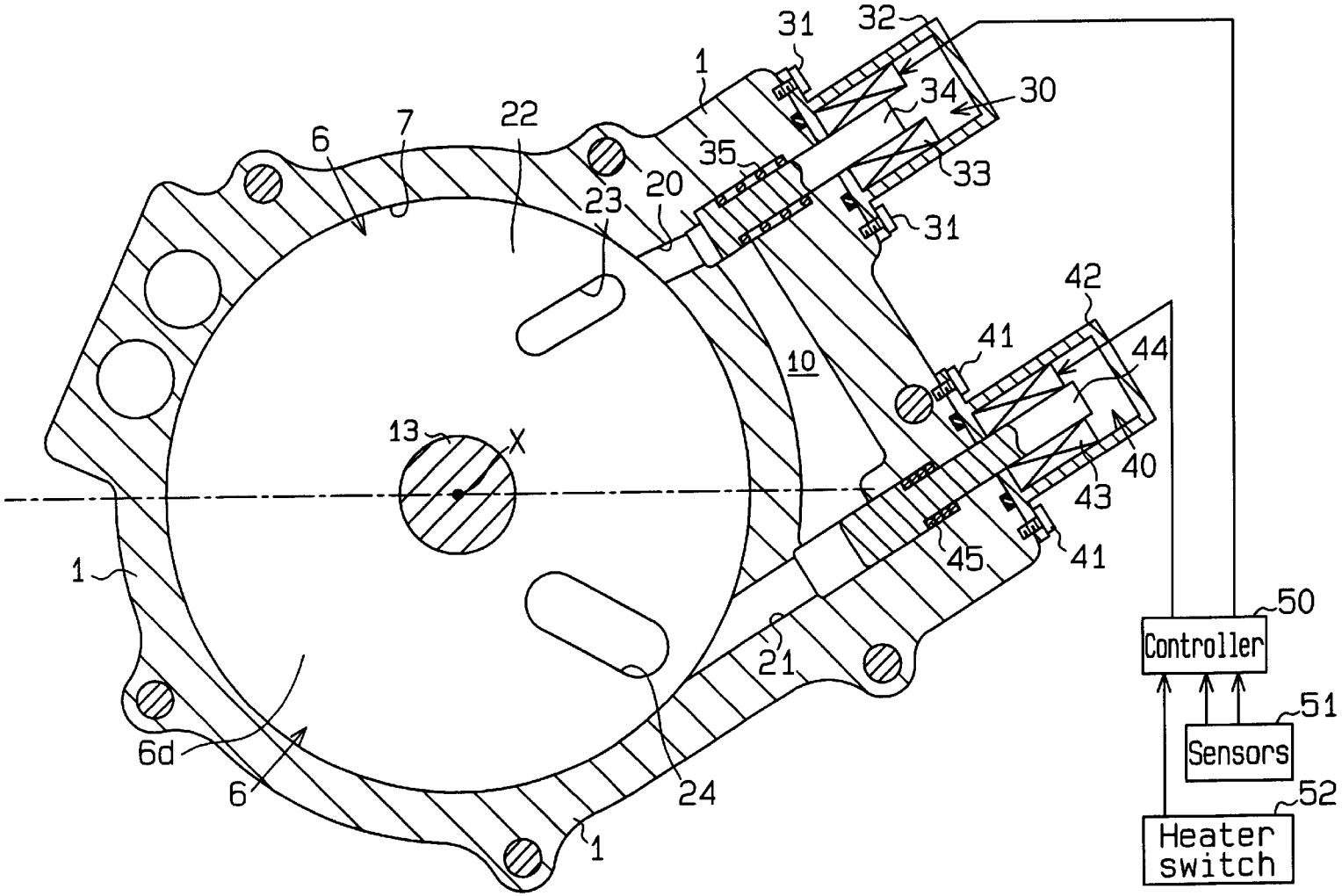
FIG. 5 is a cross-sectional view taken on line 3—3 of FIG. 1 showing the state of the heater when the rotor is rotating fast.

As shown in FIGS. 3 and 5, a first solenoid 30 is attached to the housing part 1. The first solenoid 30 is accommodated in a case 32. The case 32 is attached to the periphery of the housing part 1 by bolts 31. The first solenoid 30 includes a first coil 33 and a first piston 34 located inside the coil. The first piston 34 occupies a cylindrical space of the housing part 1. The head of the first piston 34 faces the exit opening of the return passage 20. The diameter of the head of the piston 34 is larger than the diameter of the exit opening of the return passage 20. The first piston 34 changes position between a retracted position shown in FIGS. 2, 3, and an extended position shown in FIG. 5. The passage between the heating chamber 7 and the reservoir 10 is largest when the head is placed at the outer position and smallest when the head is placed at the extended position. The position of the first piston 34 adjusts the opening size of the passage between the heating chamber 7 and the reservoir 10. When the first piston 34 is placed at the extended position, the return passage is not completely closed, and the heating chamber 7 and the reservoir 10 are not completely cut off.

A first spring 35 is provided between the head of the piston 34 and an inner wall of the housing part 1. The first spring 35 urges the first piston 34 towards the extended position.

Further, a second solenoid 40 is attached to the housing part 1. The second solenoid 40 has a similar construction as the first solenoid 30. The second solenoid 40 is accommodated in a case 42, which is attached to the housing part 1 by bolts 41, and includes a second coil 43 and a second piston 44. The second piston 44 occupies a cylindrical space of the second housing part 2. The head of the piston 44 has a larger diameter than the diameter of the entrance opening of the supply passage 21 and faces the supply passage 21. The size of the passage between the heating chamber 7 and the reservoir 10 is adjusted by the position of the second piston 44. The position of the second piston 44 changes between a retracted position shown in FIG. 5 and an extended position shown in FIG. 3. When the second piston 44 is positioned at the retracted position, the opening degree between the heating chamber 7 and the reservoir 10 is largest. When positioned at the extended position, the second piston completely closes the supply passage 20 and shuts off the heating chamber 7 from the reservoir 10. A second spring 45 is located between the front end of the second piston 44 and an inner wall of the housing part 1. The second spring 45 urges the second piston 44 towards the extended position.

As shown schematically in FIGS. 2, 3, 5, a controller 50 controls the circulation of silicone oil between the heating chamber 7 and the reservoir 10. The controller 50 may be incorporated in the vehicle heater body or provided as an independent unit. When the controller 50 is not built in the vehicle heater body, an electric control unit (ECU) of an engine (not shown) may perform the function of the controller 50.

The controller 50 is a control unit similar to a microcomputer including a CPU, ROM, RAM, and input-output interface (none is shown). A control program is stored in the ROM in advance. The controller 50 is connected to a group of sensors 51. The sensors 51 include a sensor for detecting engine speed and a temperature sensor. The temperature sensor detects, for example, the temperature of the vehicle passenger compartment or the outside air temperature, the coolant temperature, and the silicone oil temperature. The controller 50 is connected to the sensors 51 and a heater switch 52 (temperature setting apparatus). The heater switch 52 for determining the heater operation is provided on a control panel located in the passenger compartment.

The controller 50 receives signals from the sensors 51 and the heater switch 52 and controls the supply of current to each coil 33, 43 based on the control program.

An operation of the heater according to the present invention will now be explained according to each situation.

Situation 1: when engine E is being started

When the engine E is stopped, the pulley 16, the drive shaft 13 and the rotor 14 are also stopped. In this state, current is not supplied to either coil 33, 43. The first and second pistons 34, 44 are positioned at the extended position by the springs 35, 45. For Situation 1, let us assume the silicone oil is divided between the reservoir 10 and the heating chamber 7.

When a starter motor is rotated to start the engine E, the pulley 16, the drive shaft 13 and the rotor 14 start rotating. Simultaneously, the controller 50 starts feeding a current to the first coil 33. Then, the first coil 33 produces an electromagnetic force and the first piston 34 is retracted against the force of the first spring 35. The silicone oil remaining in the heating chamber flows along the wall in the heating chamber as the rotor 14 rotates. Some of the oil is guided by the discharge groove 23 into the return passage 20. Then, the oil enters the reservoir 10.

At this moment, the entrance opening 200 is open on both sides of the rotor, as seen in FIG. 4. Further, the through holes 14*a* maintain equal pressures in the clearance L1 and the clearance L2. Thus the oil returns easily from both sides of the rotor to the return passage 20. After the oil is returned, the rotor rotates without the resistance of the oil. The return of the oil is completed within short time after the starter motor is started. Accordingly, the load on the starter motor is promptly minimized within a short time.

When the engine E starts moving, the controller 50 stops the current to the first coil 33. Then, the first piston 34 moves to the extended position, and the passage opening area between the return passage 20 and the reservoir 10 is smallest. From this time on, nothing changes as long as the switch 52 is turned off. Accordingly, the silicone oil is stored in the reservoir 10, and the heating chamber 7 is empty of oil, and the rotation of the rotor 14 does not produce heat.

Situation 2: heater operation after the engine is started

When the heater switch 52 is turned on to start the heating system while the engine E is operating, the controller 50 starts applying a current to the second coil 43. Then, the second coil 43 produces electromagnetic force, and the second piston 44 is moved to the retracted position against the force of the second spring 45. This opens the supply passage 21 as shown in FIG. 5. Then, the silicone oil in the reservoir 10 flows into the heating chamber 7. Since the level of silicone oil in the reservoir is located above that in the heating chamber 7, the silicone oil of the reservoir 10 easily flows to the heating chamber 7. Since the exit opening 210 of the supply passage 21 opens to both sides of the rotor 14, the oil is equally supplied to both clearances L1, L2.

Further, when the rotor 14 rotates, the grooves 24 facilitate the flow of the oil and the clearances L1, L2 are filled.

The silicone oil in the heating chamber produces heat by the shearing of the rotor 14. The heat is transferred to the coolant flowing through the first and second water jackets 8, 9 and used for heating the passenger compartment.

Situation 3: feedback control of heat generation amount

When the engine E is operating and the heater switch 52 is turned on, the controller 50 adjusts the current supplied to the second coil 43 and thus controls the heat generation amount. This control is performed with reference to the signals from the sensors 51, and the heat generation amount is feedback-controlled so that the temperature of the vehicle compartment reaches a predetermined set temperature.

When the temperature in the vehicle compartment is lower than the set temperature, the controller 50 supplies current to the second coil 43 only. Then, the second piston 44 moves to the retracted position to open the supply passage 21, and the first piston 34 is positioned at the extended position. In this state, the oil supply amount is greater than the oil return amount, and the quantity of oil in the heating chamber 7 gradually increases. Simultaneously, the increase of the total friction between the rotor 14 and the oil increases the heat generation amount.

When the temperature of the vehicle compartment is higher than a set temperature, the controller 50 stops the supply of current to the second coil 43. Then, the second piston 44 is positioned at the extended position to close the supply passage 21. This shuts off the oil supply from the reservoir 10 to the heating chamber 7, and the oil is returned through the return passage 20. As a result, the quantity of oil in the heating chamber 7 decreases and the rotor 14 rotates without much oil. The decrease of friction between the rotor 14 and the oil decreases the heat generation amount. In this way, the position control of the piston 44 adjusts the heat generation amount of the heater.

When the heater switch 52 is turned off, the controller 50 stops the supply of current to the second coil 43. Then, as already described, the oil is returned through the return passage 20 and the heat generation is stopped.

Situation 4: when the engine E is stopped and restarted

When the engine E is stopped, the pulley 16, the drive shaft 13 and the rotor 14 also stop. If the heater switch 52 is on when the engine E (or the rotor 14) stops, the controller 50 stops the supply of current to the second coil 43, and the oil supply is stopped. The oil being sheared in the heating chamber 7 remains in the heating chamber 7. Later, when the engine E is started again, the heater operates as described in Situation 1.

The vehicle heater of the present invention has the following advantages.

A portion of the entrance opening 200 of the return passage 20 faces each of the first and second clearances L1, L2. This facilitates the flow of the silicon oil in the heating chamber from both clearances L1, L2 to the return passage 20 when the rotor starts to rotate.

Further, the discharge grooves 23 are formed near the opening 200 and extend toward the center of the heating chamber 7. As a result, the silicone oil in the heating chamber 7 is quickly returned to the reservoir 10 through the return passage 20 by rotation of the rotor 14 after the starter motor is turned on. Accordingly, the rotor 14 is promptly released from the load of the oil, and this prevents torque shock and reduces noise and early wear of the parts.

A portion of the exit opening 210 of the supply passage 21 faces each of the first and second clearances L1, L2. This permits the smooth flow of the silicone oil in the reservoir 10 to the clearances L1, L2 through the supply passage 21. Accordingly, the heater swiftly generates heat.

Further, on the recess 5*d* and the front surface 6*d*, the intake grooves 24 are formed near the exit opening 210 and extend from the center area toward the periphery of the heating chamber 7. Accordingly, the silicone oil in the reservoir 10 is guided into the intake grooves 24 and is promptly delivered to the center area of the heating chamber 7.

The surfaces of the intake grooves 24 are shaped to correspond to the outline of the supply passage 21 in a cross-sectional view, such as that of FIG. 4. The maximum distance K between the grooves 24 is equal to the inner diameter of the exit opening 210. Accordingly, the silicone oil in the reservoir 10 is guided into the intake grooves 24 and is quickly delivered to the center area of the heating chamber 7.

The surfaces of the discharge grooves 23 are shaped to correspond to the outline of the return passage 20 in a cross-sectional view like that of FIG. 4. The maximum distance K between the grooves 23 is equal to the inner diameter of the entrance opening 200. Therefore, the silicone oil guided by the discharge grooves 23 flows smoothly into the return passage 20 through the entrance opening 200. Accordingly, the silicone oil is quickly returned to the reservoir 10 when the rotor 14 starts rotating.

The bottom of the reservoir 10 is located above the bottom of the heating chamber 7. Therefore, the silicone oil flows smoothly and quickly from the reservoir 10 to the heating chamber 7 through the supply passage 21.

The present invention may further be embodied as follows.

In Situation 2, a number of reciprocal movements of the second piston 44 may be performed to pump the silicone oil into the heating chamber after the supply passage 21 is opened. In other words, a program that repeats (two to ten times) a routine for supplying and stopping current to the second coil 43 may be stored in the ROM. The controller 50 controls current based on the program. This produces a pumping movement of the second piston 44. This positively discharges the silicone oil from the reservoir 10 to the heating chamber 7.

Each piston may also be driven by the pressure of oil or air. In other words, hydraulic or pneumatic drivers may replace the coils 33, 43.

An electromagnetic clutch may be employed between the pulley 16 and the drive shaft 13, so that the drive force of the engine E is selectively transmitted to the drive shaft 13. In this construction, the drive force is cut off as required, and this prevents the silicone oil from deteriorating from excessive heating in the heating chamber 7.

In the above embodiments, silicone oil is used as the viscous fluid. However, other fluids that generate heat by the shearing of rotor may be used.

Therefore, the present examples and embodiments are to be considered as illustrative and not restrictive and the invention is not to be limited to the details given herein, but may be modified within the scope and equivalence of the appended claims.

What is claimed is:

1. A vehicle heater for generating heat for heating a vehicle compartment, the heater comprising:

a rotor rotated by a vehicle engine, wherein the rotor has a predetermined thickness and a peripheral edge;

a heating chamber for accommodating the rotor;

a fluid, which is heated in the heating chamber when the rotor rotates;

a reservoir, wherein the fluid from the heating chamber is stored in the reservoir; and a return passage connecting the reservoir and the heating chamber, wherein the fluid returns from the heating chamber to the reservoir through the return passage, wherein the return passage has an entrance opening in an inner wall of the heating chamber, wherein the entrance opening faces the peripheral edge of the rotor, and wherein the maximum width of the entrance opening is greater than the thickness of the rotor.

2. The heater according to claim 1, wherein the center of the entrance opening of the return passage is located in a plane perpendicular to the axis of the rotor that bisects the rotor.

3. The heater according to claim 2, wherein the rotor is shaped like a disk, the heating chamber has parallel walls, one wall facing each side of the rotor, wherein each wall has a return groove that extends toward the return passage, wherein one end of each groove is located in the vicinity of the return passage.

4. The heater according to claim 3, wherein the cross-sectional shape of each groove is circular and the maximum distance between the return grooves is substantially equal to the inner diameter of the return passage.

5. The heater according to claim 1 further including a supply passage located below the return passage for supplying the fluid from the reservoir to the heating chamber, wherein the supply passage has an exit opening formed in an inner wall of the heating chamber to face the peripheral edge of the rotor.

6. The heater according to claim 5, wherein the center of the exit opening of the supply passage is located in a plane perpendicular to the axis of the rotor that bisects the rotor.

7. The heater according to claim 6, wherein each of the parallel walls has a supply groove extending toward the supply passage, wherein one end of each supply groove is located near the supply passage.

8. The heater according to claim 7, wherein the cross-sectional shape of the supply grooves are circular, and the maximum distance between the supply grooves is equal to the inner diameter of the supply passage.

9. The heater according to claim 8, wherein the reservoir is spaced apart from the heating chamber in the radial direction of the rotor.

10. A vehicle heater for generating heat for heating a vehicle passenger compartment, the heater comprising:

a rotor rotated by a vehicle engine, wherein the rotor has a predetermined thickness and a peripheral edge;

a heating chamber for accommodating the rotor;

a fluid, which is heated in the heating chamber when the rotor rotates;

a reservoir, wherein the fluid from the heating chamber is stored in the reservoir;

a return passage connecting the reservoir and the heating chamber, wherein the fluid returns from the heating chamber to the reservoir through the return passage, and a supply passage, which is located below the return passage for supplying the fluid to the heating chamber, wherein the return passage has an entrance opening in an inner wall of the heating chamber, wherein the entrance opening faces the peripheral edge of the rotor, and wherein the maximum width of the opening is greater than the thickness of the rotor;

a first valve located between in the return passage for restricting the size of the return passage, wherein the first valve does not completely close the return passage; and a second valve located in the supply passage for restricting the size of the supply passage, wherein the second valve can completely close the supply passage.

11. The heater according to claim 10, wherein the first valve is positioned to maximize the size of the return passage for a predetermined period after the rotor starts to rotate, while the second valve is positioned to completely close the supply passage.

12. The heater according to claim 11, wherein the center of the entrance opening of the return passage and the center of the exit opening of the supply passage are in a plane perpendicular to the axis of and bisecting the rotor.

13. The heater according to claim 11, wherein the rotor is shaped like disk, the heating chamber has parallel walls, one wall facing each side of the rotor, wherein each wall has a return groove that extends toward the return passage and one end of each groove is located in the vicinity of the return passage.

14. The heater according to claim 13, wherein the cross-sectional shape of each groove is circular and the maximum distance between the return grooves is substantially equal to the inner diameter of the return passage.

15. The heater according to claim 14, wherein each of the parallel walls has a supply groove extending toward the supply passage, wherein one end of each supply groove is located near the supply passage.

16. The heater according to claim 15, wherein the cross-sectional shape of the supply grooves are circular, and the maximum distance between the supply grooves is equal to the inner diameter of the supply passage.

17. A method of operating a viscous fluid heater in a vehicle, the vehicle having an engine that rotates a rotor of the heater, the heater having a heating chamber and a reservoir, wherein the heating chamber houses the rotor and contains viscous fluid, and wherein the reservoir stores viscous fluid, the method comprising:

starting the engine in the vehicle; and at approximately the same time that the engine is started, opening a valve in a return passage of the viscous heater so that viscous fluid is forced from the heating chamber to the reservoir to remove viscous fluid from the heating chamber and thus reduce the torque load produced by the viscous heater on the engine, wherein the viscous fluid is forced from the heating chamber by movement of the rotor.

18. The method according to claim 17 further including opening a supply passage extending from the reservoir to the heating chamber to cause viscous fluid to flow from the reservoir to the heating chamber to generate heat.

19. The method according to claim 18 including restricting the size of the return passage to limit the flow of rate of viscous fluid in the return passage while heat is being generated.

20. The method according to claim 18 including pumping viscous fluid from the reservoir to the heating chamber via the supply passage to generate heat.

* * * * *